US008475065B2

(12) United States Patent
Kokawa et al.

(10) Patent No.: US 8,475,065 B2
(45) Date of Patent: Jul. 2, 2013

(54) PORTABLE PRINTER WITH ASYMMETRICALLY-DAMPED MEDIA CENTERING

(75) Inventors: Naoki Kokawa, Tustin, CA (US); Guy M. Heaton, Rancho Santa Margarita, CA (US); Chad M. Gundlach, Ladera Ranch, CA (US)

(73) Assignee: Datamax-O'Neil Corporation, Orlando, FL (US)

( * ) Notice: Subject to any disclaimer, the term of this patent is extended or adjusted under 35 U.S.C. 154(b) by 387 days.

(21) Appl. No.: 12/904,467

(22) Filed: Oct. 14, 2010

(65) Prior Publication Data

US 2011/0200375 A1 Aug. 18, 2011

Related U.S. Application Data

(60) Provisional application No. 61/304,964, filed on Feb. 16, 2010.

(51) Int. Cl.
*B41J 3/36* (2006.01)

(52) U.S. Cl.
USPC ..... 400/88; 400/613; 400/583

(58) Field of Classification Search
USPC ..... 400/88, 633, 642, 611, 613, 583, 400/205.1, 120.16, 120.17; 271/171; 242/596, 242/596.2, 596.4, 596.5, 596.1, 598.1
See application file for complete search history.

(56) References Cited

U.S. PATENT DOCUMENTS 3,999,110 A 12/1976 Ramstrom et al.
4,738,176 A 4/1988 Cassia
4,895,466 A 1/1990 Hartman et al.
4,909,648 A 3/1990 Hartman et al.
5,087,137 A 2/1992 Burnard et al.
5,322,377 A 6/1994 Asai
5,326,182 A 7/1994 Hagstrom
5,354,139 A 10/1994 Barrus et al.
5,381,295 A 1/1995 Rund et al.
5,483,624 A 1/1996 Christopher et al.
5,594,838 A 1/1997 Christopher et al.
5,805,779 A 9/1998 Christopher et al.
5,813,343 A 9/1998 Harb
5,833,800 A 11/1998 Goodwin et al.
5,836,704 A 11/1998 Lau et al.

(Continued)

OTHER PUBLICATIONS

International Search Report dated Dec. 2, 2010 regarding PCT/US10/52653.

*Primary Examiner* — Matthew G Marini
(74) *Attorney, Agent, or Firm* — Carter, DeLuca, Farrell & Schmidt, LLP

(57) ABSTRACT

A portable printer having improved ergonomic and operational characteristics. The printer includes an asymmetrically-damped media centering mechanism having first and second media support members moveable along a common longitudinal axis and configured to grasp roll media. The media support members are coupled to a reciprocal movement mechanism configured to translate a longitudinal movement of the first media support member into a corresponding opposite longitudinal movement of the second media support member. A pivoting arm is coupled to the reciprocal movement mechanism. The pivoting arm pivots to a first position when the first and second media support members are moved closer to each other, which causes a damping gear to engage the reciprocal movement mechanism, thereby damping the grasping motion of the media support members and providing an improved user experience. The printer facilitates one-handed operation, including one-handed loading and unloading of media, enabling its use in a variety of environments.

14 Claims, 13 Drawing Sheets

U.S. PATENT DOCUMENTS 5,927,875 A 7/1999 Lau et al.
5,938,350 A 8/1999 Colonel
6,068,418 A 5/2000 Fox
6,127,678 A 10/2000 Christensen et al.
6,129,463 A 10/2000 Lau et al.
6,130,699 A 10/2000 Christensen et al.
6,155,732 A 12/2000 Plasschaert et al.
6,158,342 A 12/2000 Moore
6,163,538 A 12/2000 Brown et al.
6,202,954 B1 3/2001 Tobin et al.
6,260,834 B1 7/2001 Colonel et al.
6,302,604 B1 10/2001 Bryant et al.
6,386,775 B1 5/2002 Hamisch, Jr. et al.
6,396,070 B1 5/2002 Christensen et al.
6,425,548 B2 7/2002 Christensen et al.
6,431,492 B1 8/2002 Chillscyzn
6,533,476 B2 3/2003 Hamisch, Jr. et al.
6,609,844 B1 8/2003 Petteruti et al.
6,616,362 B2 9/2003 Bouverie et al.
6,695,500 B2 * 2/2004 Kim et al. ..... 400/613
6,712,112 B2 3/2004 Goodwin et al.
6,805,183 B2 10/2004 Goodwin et al.
6,846,121 B2 1/2005 Bouverie et al.
6,874,958 B1 4/2005 Panebianco et al.
7,004,462 B2 2/2006 Bryer
7,033,097 B2 4/2006 Petteruti et al.
7,040,822 B2 5/2006 Fries et al.
7,042,478 B2 5/2006 Bouverie et al.
7,131,778 B2 11/2006 Tobin et al.
7,189,576 B2 3/2007 Fukuoka et al.
7,372,475 B2 5/2008 Vazac et al.
7,375,832 B2 5/2008 Bouverie et al.
7,387,456 B2 6/2008 Huggins et al.
7,502,042 B2 3/2009 Hitz et al.
7,537,404 B2 5/2009 Bouverie et al.
7,600,684 B2 10/2009 Tobin et al.
7,699,650 B1 4/2010 Liao et al.
2003/0141655 A1 7/2003 Bryer
2003/0205863 A1 11/2003 Yang
2005/0109602 A1 5/2005 Parkinson et al.
2005/0191107 A1 * 9/2005 Christie ..... 400/208
2006/0180737 A1 8/2006 Consiglio
2006/0216098 A1 * 9/2006 Lyman ..... 400/613
2007/0166092 A1 7/2007 Liu et al.
2008/0073836 A1 3/2008 Zuleger et al.

* cited by examiner

A-A

B-B

PORTABLE PRINTER WITH ASYMMETRICALLY-DAMPED MEDIA CENTERING

CROSS-REFERENCE TO RELATED APPLICATION

This application claims priority from, and the benefit of, U.S. Provisional Application Ser. No. 61/304,964, filed Feb. 16, 2010, the entirety of which is hereby incorporated by reference herein for all purposes.

BACKGROUND

The present disclosure relates to continuous feed printers, and more particularly, to a portable label or thermal printer having a selectively adjustable, asymmetrically damped media centering assembly.

Portable or desktop printers are often used in commercial settings, e.g., in warehouses, in industrial and manufacturing environments, by shipping services, in vending machine routes, in the vending and gaming industries, and in retail establishments for ticket printing and inventory control. Ideally, portable printers weigh only a few pounds and are small enough to be easily carried during use and/or easily attached to a buckle or a harness-type device. This enables the user to print labels or receipts on demand without having to retrieve a printed label from a printing station. Because the printer is portable, the printer may include a power source, such as a disposable or rechargeable battery, and may additionally communicate with a host terminal or network connection via a wireless interface, such as a radio or optical interface. A portable printer may utilize sheet-fed media, or, more popularly, continuous-feed media, e.g., rolls of paper, labels, tags, and the like. Portable printers commonly employ direct thermal transfer techniques, whereby thermochromic media passes over a thermal print head which selectively heats areas of the media to create a visible image. Also popular are thermal transfer printers which employ a heat-sensitive ribbon to transfer images to media.

A continuous feed printer is particularly suitable for printing onto stock material which may include, but is not necessarily limited to, labels, receipts, item labels, shelf labels/tags, ticket stubs, stickers, hang tags, price stickers, and the like. Label printers may incorporate a media supply of "peel away" labels adhered to a coated substrate wound in a rolled configuration. Alternatively, a media supply may include a plain paper roll suitable for ink-based or toner-based printing. Continuous media is typically supplied in rolls, and is available in a wide range of widths. The roll media may be wound around a generally tubular core which supports the roll media. The core may have a standard size, or arbitrarily-sized inner diameter. In use, the media is drawn against a printing head, which, in turn, causes images to be created on the media stock by, e.g., impact printing (dot matrix, belt printing), by localized heating (thermal transfer printing), inkjet printing, toner-based printing, or other suitable printing methods.

Portable or thermal printers may be designed for use with one type of printing media or one particular size of print media, e.g., 2-inch label stock or 3-inch label stock. Other portable printers may be configurable to accommodate different media types and sizes. Such printers may include a media centering mechanism which is designed to accommodate roll media of varying widths and/or core diameters. The media centering mechanism may include opposing support members configured to engage the media roll core. A media centering mechanism typically includes first and second support members that are generally biased towards each other to secure the media roll. Movement of the first and second support members may be synchronized by one or more gears or belts such that, when a support member is moved a distance from the centerline of the media roll, the other support member moves a corresponding distance in the opposing direction from the centerline of the media roll.

Many of the media centering mechanisms associated with portable printers are not particularly versatile or convenient to use, and may employ various spring-loaded elements that are intended to accommodate media of various types and sizes. As a result, even though certain portable printers may accommodate media of various sizes, to load such media a user must manipulate the spring-loaded members and other mechanical elements using both hands. Such spring-loaded elements can suddenly snap into position with considerable force, which may result in an unpleasant user experience, damage to the print media, and even damage to the printer itself.

SUMMARY

The present disclosure is directed to a portable printer having an asymmetrically-damped media centering mechanism. The mechanism allows a user to open the spring-loaded media support members with ease, but, upon release, damping is provided to the media support members to cause the retraction thereof to occur at slower, controlled rate. In this manner, the disclosed media centering mechanism may facilitate easier media loading (including one-handed loading), may provide an improved user experience, and may prevent damage to the print media and/or to the printer.

The dampening mechanism includes a damping gear, and a pivoting arm having at least one idler gear wherein the pivoting arm pivots between at least a first, non-damped position and a second, damped position in response to movement of a media support member. The damping gear includes a rotational resistance element, such as, without limitation, damping grease, a frictional mechanism, a regenerative braking mechanism, a magnetic braking mechanism, a centrifugal governor, and combinations thereof and/or of other suitable rotational resistance elements now or in the future known. The idler gear cooperates with one or more drive elements associated with the media support member, such as without limitation, a rack and pinion drive and/or a belt drive. The pivot arm is arranged such that, when a media support member is moved toward an open position, the drive element causes the pivot arm to move into the non-damped position wherein the idler gear on the pivot arm is disengaged from the damping gear, thus allowing free movement of the media support member. When the media support member moves toward the closed position, the pivot arm moves into the damped position wherein the idler gear on the pivot arm engages the damping gear, which in turn slows the motion of the drive element and media support member. In this manner, asymmetrical damping is achieved whereby the media support members open freely against only the spring force, but retract slowly with the dampening effect as the idler gear engages the dampening gear.

An asymmetrically-damped media centering mechanism is disclosed which includes a first media support member moveable along a longitudinal axis thereof and a second media support member moveable along a longitudinal axis thereof. The first and second media support members may share a common longitudinal axis of movement. The disclosed media centering mechanism includes a reciprocal movement mechanism operably coupled to the first and second media support members that is configured to translate a longitudinal movement of the first media support member into a corresponding opposite longitudinal movement of the second media support member. The media centering mechanism further includes a pivoting arm coupled to the reciprocal movement mechanism. The pivoting arm is pivotable between at least a first and a second position. During use, the pivoting arm pivots to the first position when the first and second media support members are moved closer to each other (e.g., when grasping or closing onto a media roll positioned therebetween), and the pivoting arm pivots to the second position when the first and second media support members are moved further apart from each other (e.g., when spreading the media support members to insert a media roll therebetween). A damping gear is provided that is configured to engage the reciprocal movement mechanism when the pivoting arm is in the first position. The reciprocal movement mechanism may include a first and second drive member operably coupled to the first and second media support members, respectively, and may include a drive belt operably coupled to the first and second drive members and at least partially disposed around the driven gear. Additionally or alternatively, the reciprocal movement mechanism may include a first and second rack member operably coupled to the first and second media support members, respectively, wherein a pinion gear is operably engageable with the first and second rack members and configured to translate movement of the first rack member into a corresponding opposite movement of the second rack member. In embodiments, the pinion gear is axially coupled to the driven gear.

Also disclosed is a method of centering a media roll, comprising the steps of providing a first and a second media support member moveable along a longitudinal axis and dimensioned to axially engage a media roll. The method includes the step of providing a reciprocal movement mechanism operably coupled to the first and second media support members wherein a longitudinal movement of one media support member causes a corresponding opposite longitudinal movement of the other media support member. A pivoting arm is provided, which operably couples to the reciprocal movement mechanism, wherein the pivoting arm pivots to the first position when the media support members arc moved closer to each other, and the pivoting arm pivots to the second position when the media support members are moved further apart from each other. A damping gear is provided which is configured to engage the reciprocal movement mechanism when the pivoting arm is in the first position.

Also disclosed is a portable printer that includes a display having an overmolded bezel associated therewith. The overmolded bezel is formed from resilient material that provides shock resistance and which protects the display, printer, and associated components thereof from damage in the event the portable printer is dropped or otherwise mishandled. In embodiments, the overmolded bezel is formed from Versollan™ OM 1255NX-9, a thermoplastic elastomer manufactured by PolyOne Corporation of Avon Lake, Ohio, USA. The overmolded bezel additionally or alternatively seals the display and printer to resist the infiltration of contaminants, e.g., dust and moisture, into the display and/or printer.

Disclosed is a portable printer having ergonomic enhancements. In embodiments, a printer in accordance with the present disclosure includes a media loading arrangement capable of single-handed operation. A media cover may be unlatched using a lever operable by a single hand. Using a single hand, the media cover may be fully unlatched, e.g., both sides freed from an associated housing, such that the media cover swings clear of the housing to expose a media storage well. Media may be loaded into the media storage well and the media cover closed with one hand. Single-handed operation may provide a number of benefits. In one envisioned scenario, the portable printer may be hung from the waistbelt of a user, e.g., a warehouse worker. Such a worker is often situated precariously, such as on a forklift, on an elevated platform of a Hi-Lo machine, and the like, wherein using two hands to manipulate a portable device may be hazardous. By facilitating one-handed operation, a portable printer in accordance with the present disclosure may offer safer, more convenient, and more reliable operation.

In another aspect, a portable printer in accordance with the present disclosure includes a dual wall, frame housing that provides improved strength and shock resistance. The dual wall construction includes a continuous inner frame structure adapted to support one or more internal printer components, which may include, without limitation, a printhead, a roller assembly, a drive assembly, media centering assembly, and/or a battery assembly. The inner frame is surrounded at least in part by a second, outer structure that provides additional stiffness, strength, and drop resistance. The housing includes a media access opening and a corresponding media access cover configured to facilitate the loading of media into the printer. The size of the media access opening is kept to the minimum size necessary to accommodate the media for use with the printer. By minimizing the media opening, greater space is available for the inner frame and/or the outer structure, further improving the strength, rigidity, and impact resistance of the printer.

The disclosed printer may include one or more connectors that extend from the interior of housing to the exterior. While the connector(s) may include an electrical connector, other connector types are contemplated within the scope of the present disclosure, e.g., moisture-proof connectors, fluidic connectors, security connectors (e.g., K-Slot), and the like. In embodiments, two electrical connectors are provided, wherein a first connector is adapted to couple a source of electrical power to the printer and a second connector is adapted to couple a data signal to the printer. In embodiments, the disclosed printer may include a USB connector, a serial (e.g., RS-232, RS-422, RS-485), connector, a Firewire (IEEE-1394) connector, a network (10Base-T, 100Base-TX, and 1000Base-T) connector, and/or a parallel (IEEE 1284) connector. The disclosed printer may additionally or alternatively include a dust cover assembly that is adapted to cover one or more connectors. The dust cover assembly includes a cap portion that is dimensioned to seal the one or more connectors associated with the dust cover. In embodiments, the dust cover is formed from resilient material. The cover is joined to a base by a resilient hinge or tethering member that retains the cap portion to the base. The cap, hinge member, and base may be integrally formed. The hinge member may be a living hinge. The base is retained to the printer by any suitable manner of fastening, including without limitation, threaded fasteners, clips, tabs, and the like. Advantageously, the dust cover assembly may be user-replaceable, so that a worn or broken dust cover assembly may be readily replaced with a new dust cover assembly. In embodiments, a spare dust cover assembly may be stored within a recess provided by the printer housing.

A portable printer having a media feed cover assembly is disclosed. In certain applications, it may be desirable to feed media into the printer from an external media source. To facilitate external media feeding, the disclosed printer includes a media feed opening defined in the housing. A media feed cover is provided to seal the media feed opening from moisture, dust, and other contaminants. The media feed cover is supported by a pocket formed between the outer enclosure and the inner frame. The cover assembly is configured to provide two or more detents to enable the cover to be positioned in an open and a closed position. In an embodiment, the pocket includes a recess in the open and closed position that provides detents for each of the open and closed positions.

Also disclosed is a portable printer that includes an upper inner frame structurally associated with a lower inner frame to form an inner support structure. An asymmetrically-damped media centering assembly is fixed to the inner support structure. An upper housing and a lower housing are joined to the inner support structure to form a dual-wall housing assembly. A media opening defined in the upper housing exposing a media well, and a media access door having at least a closed position and an open position is operatively associated with the media opening. A latch assembly having a first, normally latched position and a second, unlatched position, the latch assembly is associated with the inner support structure and is configured to retain the media access door in the closed position when the latch is in the latched position, and to release the media access door when the latch is in the unlatched position.

BRIEF DESCRIPTION OF THE DRAWINGS

Various embodiments of the subject instrument are described herein with reference to the drawings wherein.

DETAILED DESCRIPTION

Figure 1:
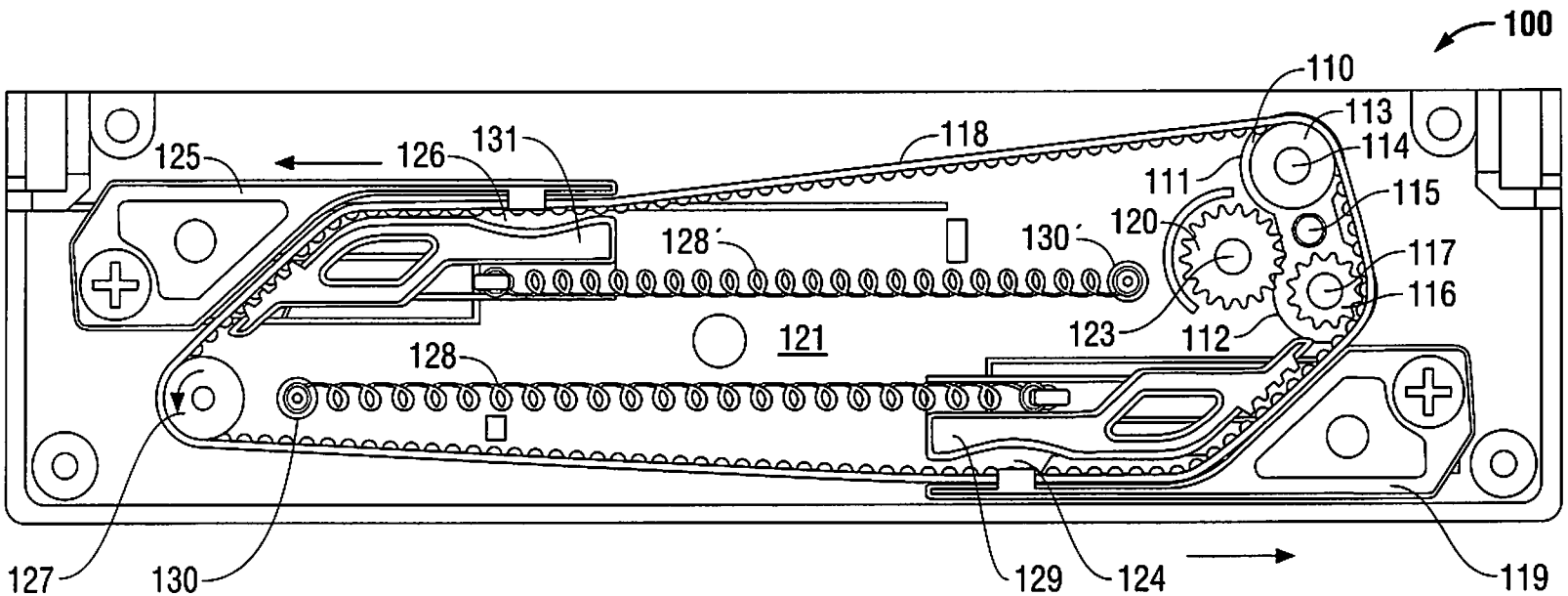
FIG. 1 is a view of an embodiment of an asymmetrical damping mechanism in accordance with the present disclosure shown in a first, non-damped position.

Particular embodiments of the present disclosure are described hereinbelow with reference to the accompanying drawings; however, it is to be understood that the disclosed embodiments are merely exemplary of the disclosure, which may be embodied in various forms. Well-known and/or repetitive functions and constructions are not described in detail to avoid obscuring the present disclosure in unnecessary or redundant detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In addition, as used herein, terms referencing orientation, e.g., "top", "bottom", "up", "down", "left", "right", "clockwise", "counterclockwise", and the like, are used for illustrative purposes with reference to the figures and features shown therein. It is to be understood that embodiments in accordance with the present disclosure may be practiced in any orientation without limitation. In this description, as well as in the drawings, like-referenced numbers represent elements which may perform the same, similar, or equivalent functions.

With reference to FIGS. 1-4, an embodiment of an asymmetrically-damped media centering mechanism 100 is shown. The disclosed mechanism 100 is adapted for use with a toothed drive belt 118 that is operably coupled to a first media support drive member 119 and a second media support drive member 125. While a toothed drive belt is shown, any suitable belt or chain may be used (e.g., vee belt, round belt, flat belt, drive chain, etc.). As shown, first drive member 119 engages drive belt 118 within a notched region 124. Second drive member 125 engages belt 118 within notched region 126. It should be noted that any suitable manner of attachment may be utilized such that linear motion of drive members 119, 125 is translated to/from drive belt 118. The disclosed arrangement of drive belt 118, first drive member 119, and second drive member 125 provides for reciprocal linear movement of drive member 119 with respect to movement of drive member 125. First drive member 119 and second drive member 125 may be slidably associated with one or more guides (not explicitly shown) that are configured to constrain the movement thereof to a substantially longitudinal axis of motion corresponding to the movement of belt 118.

A pivot arm 110 that is rotatable around a pivot pin 115 is disposed on a support member 121. Pivot arm 110 includes a first idler gear 113 and a driven gear 116 rotatably mounted thereupon adjacent to opposite ends 111 and 112, respectively, of pivot arm 110. First idler gear 113 and driven gear 116 are positioned on pivot arm 110 in essentially coplanar alignment with drive belt 118. Drive belt 118 is disposed around idler gears 113 and 116 at one end of the mechanism 100, and around a second idler gear 127 at an opposite end of mechanism 100. As shown, drive belt 118 is continuous, however, drive belt 118 may be discontinuous or segmented.

A biasing member 128 is disposed between a free end 129 of drive member 119 and an anchor 130 and adapted to bias drive member 119 away from pivot arm 110. Additionally or alternatively, a biasing member 128' may be disposed between a free end 131 of drive member 125 and a corresponding anchor 130'. Biasing member 128 and/or biasing member 128' may include an extension spring. At rest, biasing member 128 causes drive member 119 to be drawn leftward, and drive member 125 to be drawn rightward, e.g., causes both drive members 119, 125 to be drawn generally towards the center of centering mechanism 100. A media support member (not explicitly shown) is associated with each of drive member 119, 125 to retain a media roll therebetween, as described herein.

Figure 4:
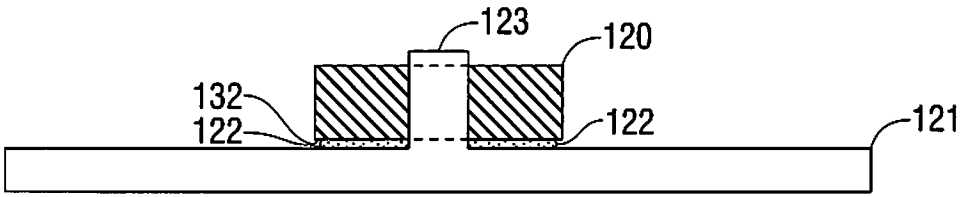
FIG. 4 is a cross-sectional view of a damping gear of the FIG. 1 embodiment of an asymmetrical damping mechanism in accordance with the present disclosure.

The disclosed media centering mechanism includes a damping gear 120 that is configured to engage driven gear 116. With particular reference to FIG. 4, damping gear 120 is associated with damping grease 122 that is applied between a movable surface 132 of damping gear 120 and a stationary surface, e.g., support member 121 and/or pin 123. It is envisioned that any suitable damping grease, such as without limitation, SmartGrease™ Fluorocarbon Gel, manufactured by Nye Lubricants, Inc. of Fairhaven, Mass., United States, may be utilized. Damping grease 122 resists the rotational motion of damping gear 120.

Referring again to FIG. 1, during use, first drive member 119 and/or second drive member 125 may be caused to be moved in a direction indicated by the arrows, e.g., generally outwardly from the center of mechanism 100, overcoming the biasing force of biasing member 128, and causing belt 118 to traverse in a generally counterclockwise direction. The counterclockwise motion of belt 118 is translated through first idler gear 113 and/or driven gear 116 to cause a corresponding counterclockwise rotation of pivot arm 110, which, in turn, causes driven gear 116 to disengage from damping gear 120. In this manner, the outward linear motion of first drive member 119 and second drive member 125 is unimpeded by damping gear 120 thus enabling a user to freely open the media support members (not explicitly shown) associated therewith to facilitate the introduction of a media roll therebetween.

Figure 2:
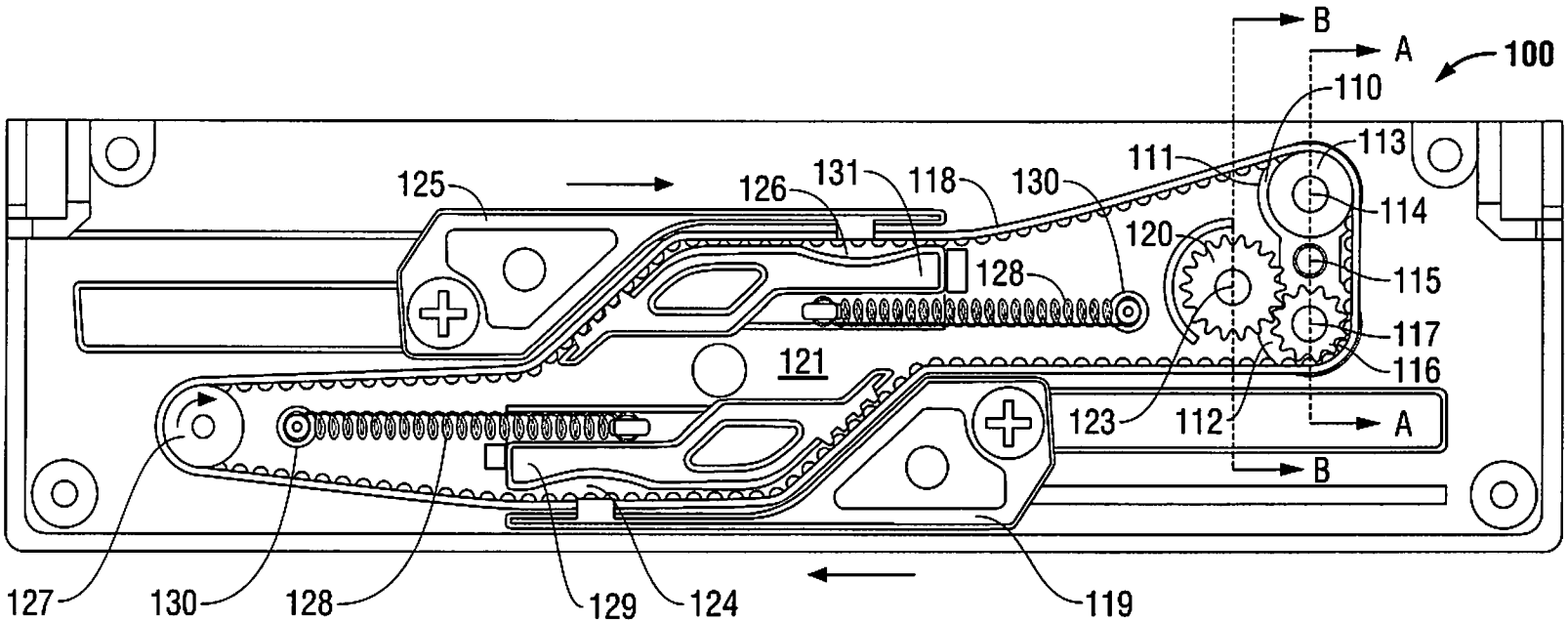
FIG. 2 is a view of the FIG. 1 embodiment of an asymmetrical damping mechanism in accordance with the present disclosure shown in a second, damped position.
Figure 3:
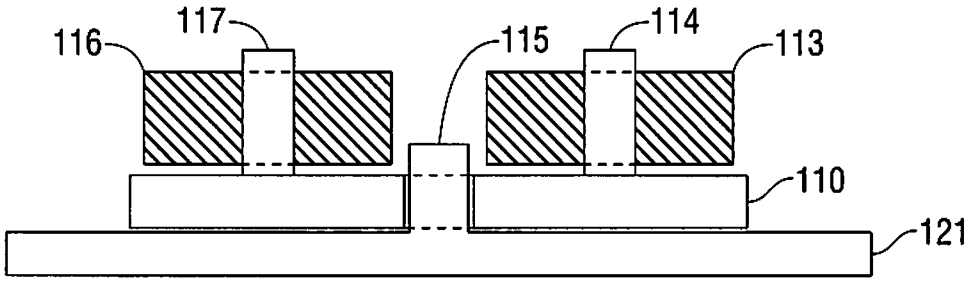
FIG. 3 is a cross-sectional view of a pivot arm of the FIG. 1 embodiment of an asymmetrical damping mechanism in accordance with the present disclosure.

Continuing now with reference to FIG. 2, the first drive member 119 and/or second drive member 125 may be caused to be moved in the opposite direction (generally inwardly towards the center of mechanism 100) by, e.g., the biasing force of biasing member 128. The described inward motion of first drive member 119 and second drive member 125, in turn, causes belt 118 to traverse in a generally clockwise direction. The clockwise motion of belt 118 is translated through first idler gear 113 and/or driven gear 116 to cause a corresponding clockwise rotation of pivot arm 110, which, in turn, engages driven gear 116 with damping gear 120. The rotational resistance of damping gear 120 is translated through driven gear 116 to belt 118, which slows the movement of first drive member 119 and second drive member 125, and the media support members associated therewith. Thus, the dampening effect of engaged dampening gear 120 enables the return, or closing, of the first drive member 119 and second drive member 125, and the media support members associated therewith, to be achieved in a smooth and controlled manner.

Other embodiments are contemplated wherein a second damping gear (not explicitly shown) may be employed to provide damping in a direction opposite to that provided by a first damping gear. In one arrangement, the second damping gear is arranged such that the pivot arm causes the second damping gear to engage one or more of the idler or driven gears mounted thereupon when the drive member(s) move in an opening direction.

Figure 5:
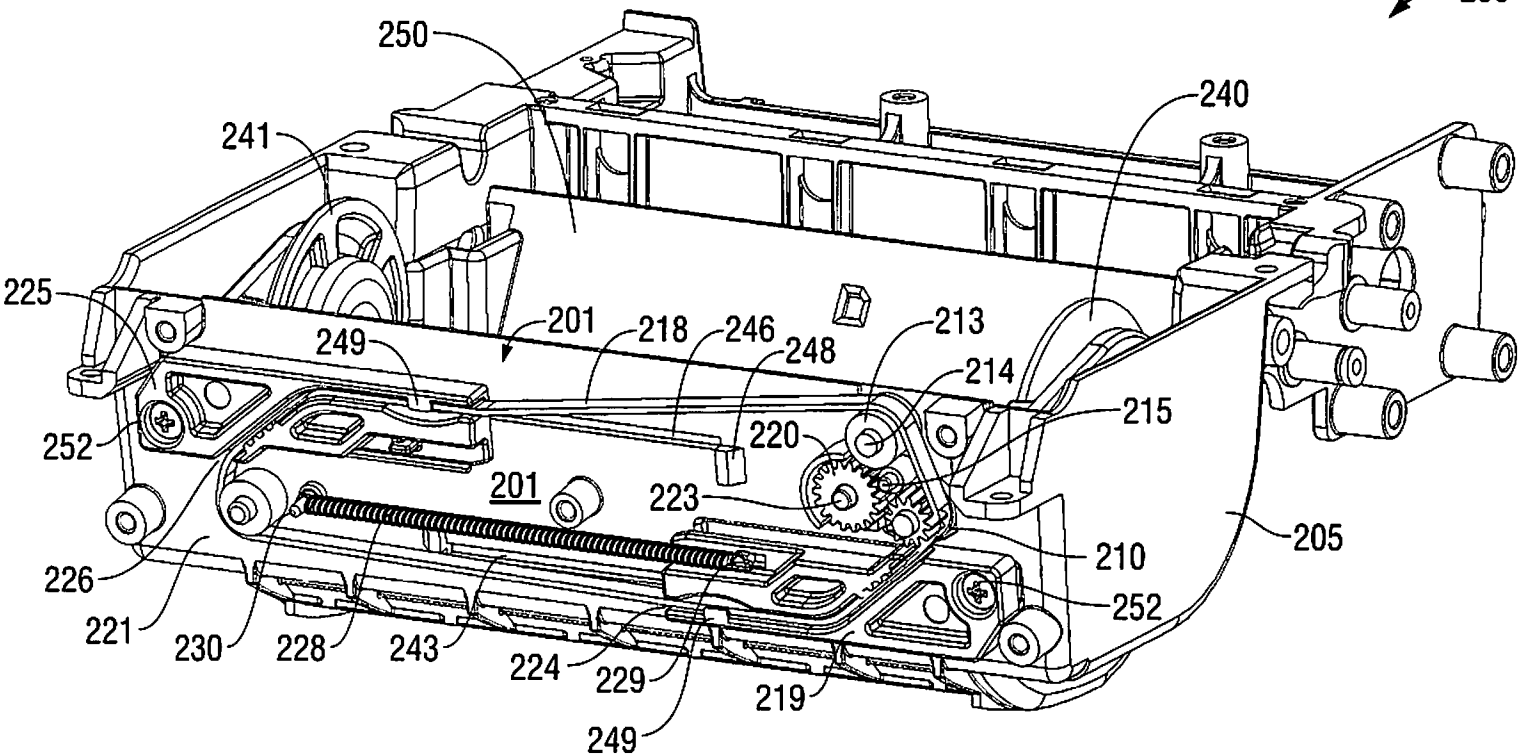
FIG. 5 is a perspective view of another embodiment of an asymmetrical damping mechanism in accordance with the present disclosure shown in a first, non-damped position.
Figure 6:
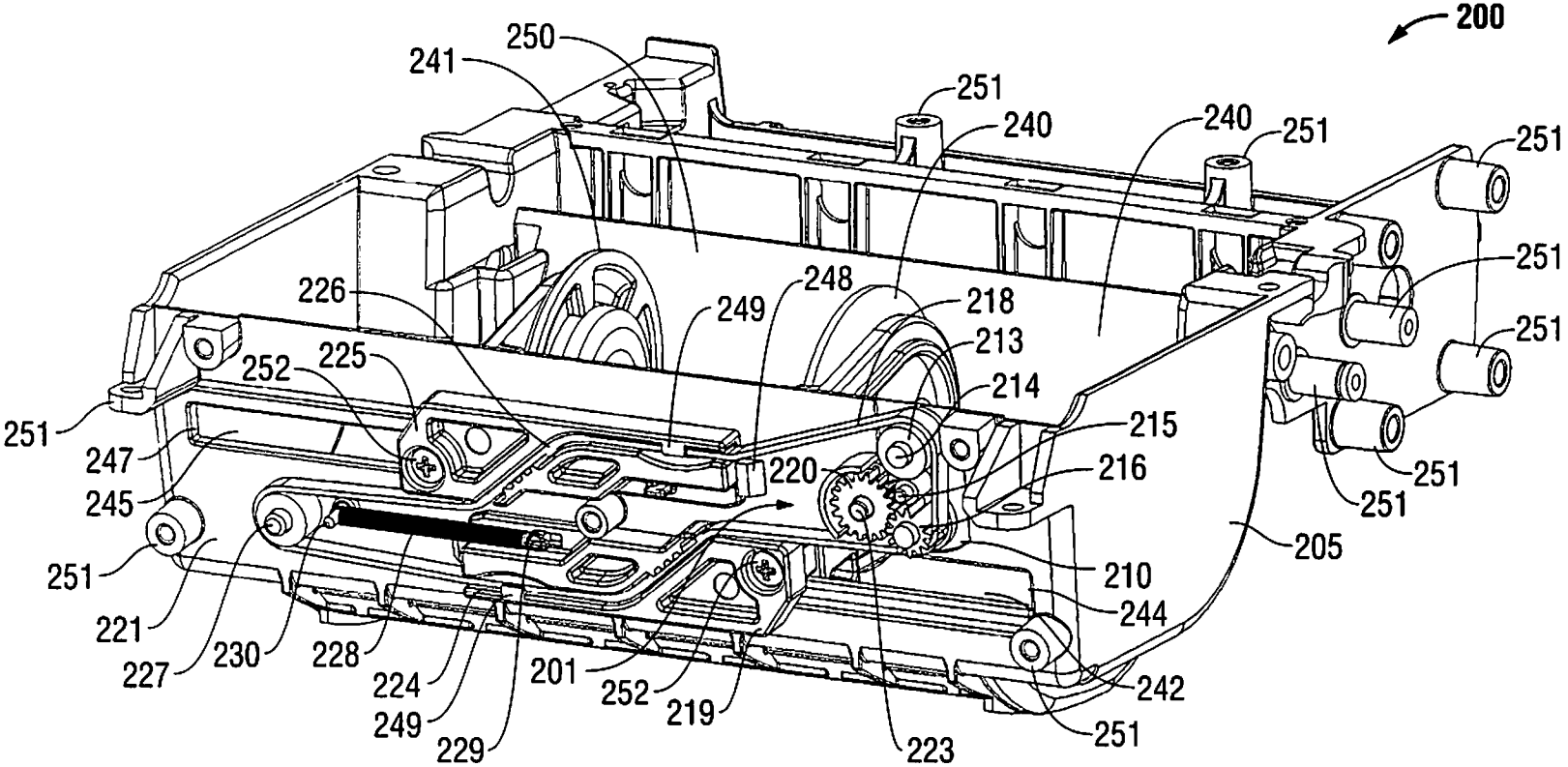
FIG. 6 is a perspective view of the FIG. 5 embodiment of an asymmetrical damping mechanism in accordance with the present disclosure shown in a second, damped position.

Turning now to FIGS. 5 and 6, an embodiment of a print media subassembly 200 having an asymmetrically damped media centering mechanism 201 is shown. Print media subassembly includes a housing 205 having defined therein a media storage well 250 that is dimensioned to accommodate a variety of roll-fed media. Housing 205 includes a support member 221 configured to support media centering mechanism 201 as described herein. Housing 205 includes one or more mounting bosses 251 configured to accept a fastener, pin, or other structural or connective element. The disclosed mechanism 201 includes a drive belt 218 that is operably coupled to a first media support drive member 219 and a second media support drive member 225. While a toothed drive belt 218 is shown, any suitable belt or chain may be used as described herein. As shown, first drive member 219 engages drive belt 218 within a notched region 224. Second drive member 225 engages belt 218 within notched region 226. First and second drive members 219, 225 include a retention tab 249 that is configured to retain belt 218 within notched region 224 and notched region 226, respectively. It should be noted that any suitable manner of retention may be utilized such that linear motion of drive members 219, 225 is translated to/from drive belt 218.

Drive belt 218, first drive member 219, and second drive member 225 provide for reciprocal linear movement of drive member 219 with respect to movement of drive member 225. First drive member 219 is slidably disposed within a slot 242 that is defined in support member 221 and includes a wide portion 244 and a narrow portion 243. Second drive member 225 is slidably disposed within a slot 245 that is defined in support member 221 and includes a wide portion 247 and a narrow portion 246. Slots 242 and 245 are configured to constrain the movement of drive members 219, 225, respectively, to a substantially longitudinal axis of motion corresponding generally to the movement of belt 218. A positive stop 248 is disposed at an end of slot narrow portion 243 and/or slot narrow portion 246 and configured to limit the longitudinal travel of drive member 219 and/or drive member 225, respectively.

A pivot arm 210 that is rotatable around a pivot pin 215 is disposed on a support member 221. Pivot arm 210 includes a first idler roller 213 and a driven gear 216 rotatably mounted on pivot arm 210. First idler roller 213 and driven gear 216 are positioned on pivot arm 210 in essentially coplanar alignment with drive belt 218. Drive belt 218 is disposed around first idler roller 213 and driven gear 216 at one end of the mechanism 201, and around a second idler roller 227 at an opposite end of mechanism 201. As shown, drive belt 218 is continuous, however, drive belt 218 may be discontinuous or segmented.

An extension spring 228 is disposed between an anchor pin 230 provided on support member 221, and a mounting tab 229 provided on drive member 219. As can be readily appreciated, extension spring 228 is configured to bias drive member 219 away from pivot arm 210, which, by operation of drive belt 218, first idler roller 213, driven gear 216, and second idler roller 227, serves to bias drive member 225 toward pivot arm 210 in a reciprocally synchronized manner. Biasing member 228 causes drive member 219 to be drawn leftward, and drive member 225 to be drawn rightward, e.g., causes both drive members 219, 225 and media support members 240, 241 respectively associated therewith to be drawn generally towards the center of storage well 250 to retain a roll of media therebetween.

First media support member 240 is operatively associated with drive member 219, and second media support member 241 is operatively associated with drive member 225. As shown, media support members 240, 241 are joined to drive members 219, 225, respectively, by a fastener 252 which may include a threaded fastener, rivet, pin, or clip, however, any suitable manner or combination of attachment may be utilized, including without limitation, chemical bonding, adhesive, welding, and the like. Media support member 240, 241 may be integrally formed with drive member 219, 225, respectively.

The disclosed media centering mechanism includes a damping gear 220 that is configured to engage with driven gear 216. Damping gear 220 is associated with damping grease (not explicitly shown) that is applied between a movable surface of damping gear 220 and a stationary surface, e.g., support member 221 and/or pin 223 and adapted to resist the rotational motion of damping gear 220. Any suitable damping grease (as previously described herein) may be utilized.

During use, a user loads a roll of media by opening one or both media support members 240, 241, inserting a roll of media (not explicitly shown) and releasing the media support members 240, 241 which retain the media roll under tension provided by extension spring 228. In greater detail, a user moves first media support member 240 and/or second media support member 241 generally outwardly from the center of mechanism 201, thereby overcoming the biasing force of extension spring 228, and causing belt 218 to traverse in a generally counterclockwise direction. The counterclockwise motion of belt 218 is translated through idler roller 213 and/or driven gear 216 to cause a corresponding counterclockwise rotation of pivot arm 210, which, in turn, causes driven gear 216 to disengage from damping gear 220. In this manner, the outward linear motion of first drive member 219 and second drive member 225 is unimpeded by damping gear 220 thus enabling a user to freely open media support members 240, 241 associated therewith to facilitate the introduction of a media roll therebetween.

Continuing, a user may relax pressure on, or release completely, media support members 240, 241 to allow first drive member 219 and/or second drive member 225 to move in the opposite direction, e.g., closing direction generally inwardly towards the center of mechanism 201 by e.g., the biasing force of extension spring 228. The described inward motion of first drive member 219 and second drive member 225, in turn, causes belt 218 to traverse in a generally clockwise direction. The clockwise motion of belt 218 is translated through first idler roller 213 and/or driven gear 216 to cause a corresponding clockwise rotation of pivot arm 210, which, in turn, engages driven gear 216 with damping gear 220. The rotational resistance of damping gear 220 is translated through driven gear 216 to belt 218, which slows the movement of first drive member 219, second drive member 225, and the associated media support members 240, 241. Thus, the dampening effect of engaged dampening gear 220 enables the return, or closing, of media support members 240, 241 to be achieved in a smooth and controlled manner.

Figure 7:
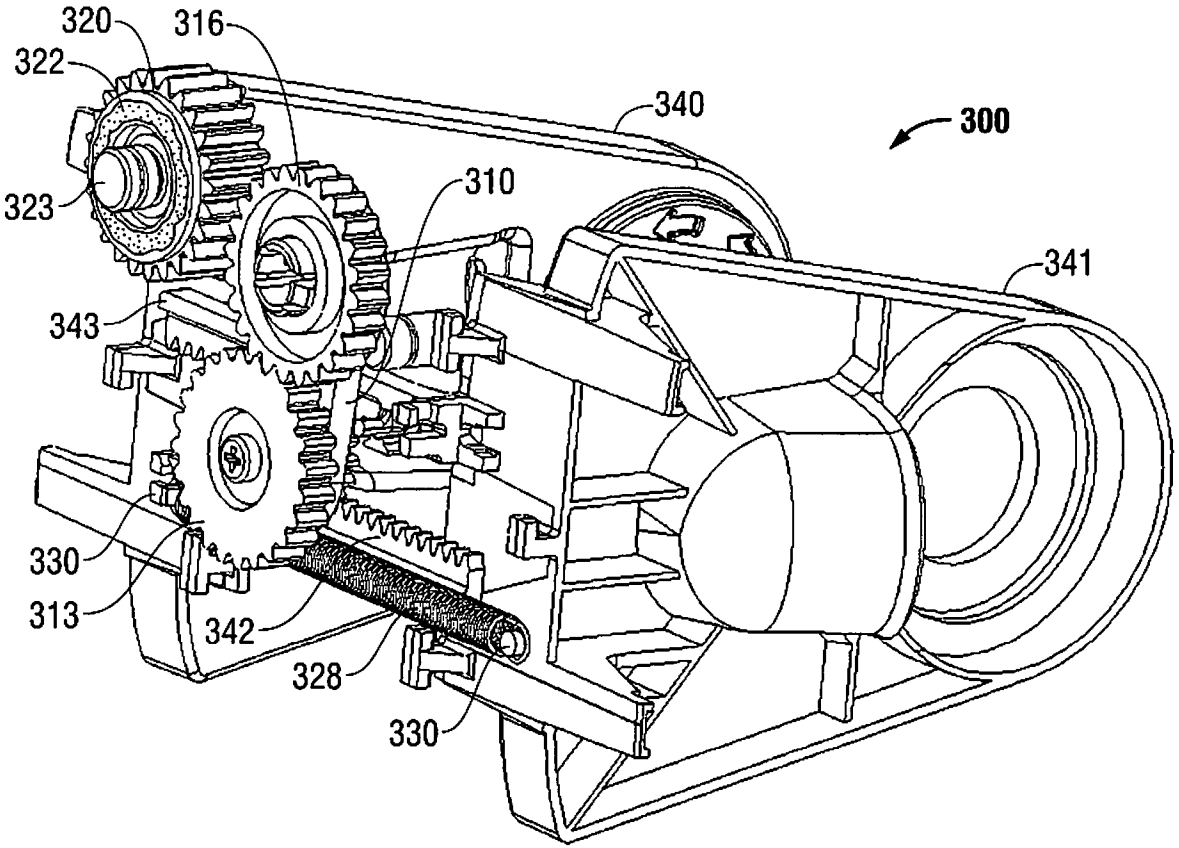
FIG. 7 is a perspective view of yet another embodiment of an asymmetrical damping mechanism in accordance with the present disclosure shown in a first, non-damped position.
Figure 8:
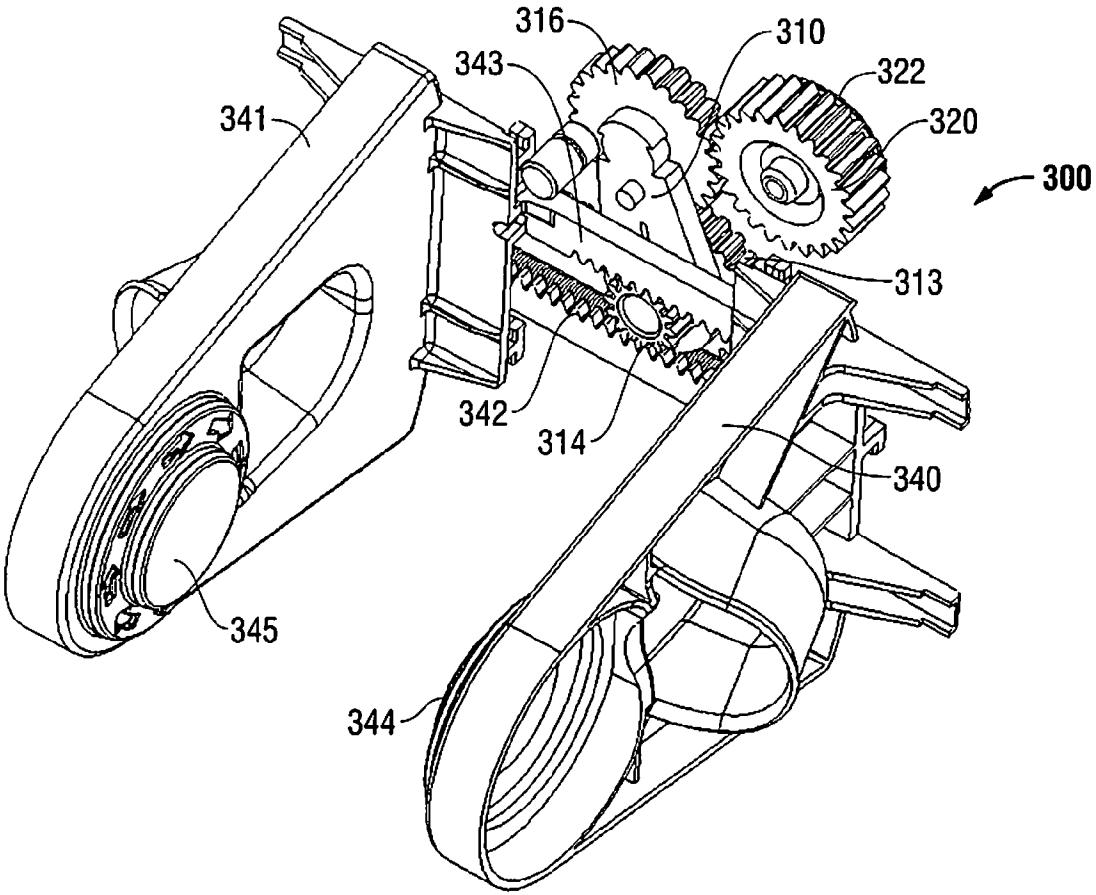
FIG. 8 is a perspective view of the FIG. 7 embodiment of an asymmetrical damping mechanism in accordance with the present disclosure shown in a second, damped position.

With reference now to FIGS. 7 and 8, an embodiment of an asymmetrically-damped media centering mechanism 300 employing a rack and pinion arrangement is shown. The disclosed media centering mechanism 300 includes a first media support member 340 and a second media support member 341. The first and second media support members 340, 341 are joined respectively to rack members 342, 343 that extend inwardly towards the center of mechanism 300. The media support members 340, 341 may be joined to the respective rack member 342, 343 by any suitable manner of attachment, including threaded fasteners, adhesive, welding, clips. Additionally or alternatively, media support members 340, 341 may be integrally formed with the respective rack member 342, 343 thereof.

Rack members 342, 343 are reciprocally synchronized by pinion gear 314 that is axially coupled to driven gear 313, such that pinion gear 314 and driven gear 313 rotate in tandem. Pinion gear 314 and driven gear 313 may be positively joined by a common shaft (not explicitly shown) and/or may be integrally formed. Media support members 340, 341 are biased toward each other by an extension spring 328 that is fixed to media support members 340, 341 by a retention clip 330. The biasing force of extension spring 328 is sufficient to secure a media roll (not explicitly shown) between media support members 340, 341. Media support members 340, 341 may include media hubs 344, 345, respectively, that are dimensioned to operatively engage an inner diameter (e.g., a core) of a media roll.

A damping gear 320 rotatably mounted on pin 323 is associated with damping grease 322 that is applied between a movable surface of damping gear 320 and an adjacent stationary surface (not explicitly shown) and/or pin 323. Damping gear 320 is adapted to resist the rotational motion thereof by the viscous friction provided by damping grease 322. As described elsewhere herein, any suitable damping grease may be utilized. In embodiments, additional or alternative friction-inducing elements may be employed in association with damping gear 320, including without limitation magnetic elements, inertial elements (e.g., a flywheel), clockworks elements, clutch mechanisms, and the like.

Pinion gear 313 engages movable gear 316 that is rotatably mounted on a pivot arm 310 that is configured to pivot on an axis (not explicitly shown) such that, when media support members 340, 341 are moved apart from each other (e.g., when loading a media roll), pivot arm 310 swings movable gear 316 away from damping gear 320, thereby disengaging movable gear 316 and damping gear 320. Conversely, when media support members 340, 341 are moved toward from each other (e.g., when a media roll is grasped therebetween for use), pivot arm 310 swings movable gear 316 towards damping gear 320, thereby engaging movable gear 316 and damping gear 320. In an embodiment, the pivot axis of pivot arm 310 is coincident with the rotational axis of driven gear 313 and/or pinion gear 314. The pivoting motion of pivot arm 310 may be induced by parasitic friction that may be present among and between driven gear 313, pinion gear 314, and/or pivot arm 310, and associated components thereof. Thus, the dampening effect of engaged dampening gear 320 enables the return, or closing, of media support members 340, 341 to be achieved in a smooth and controlled manner while permitting the opening of media support members 340, 341 to be performed without any appreciable resistance apart from that provided by extension spring 328.

Figure 9:
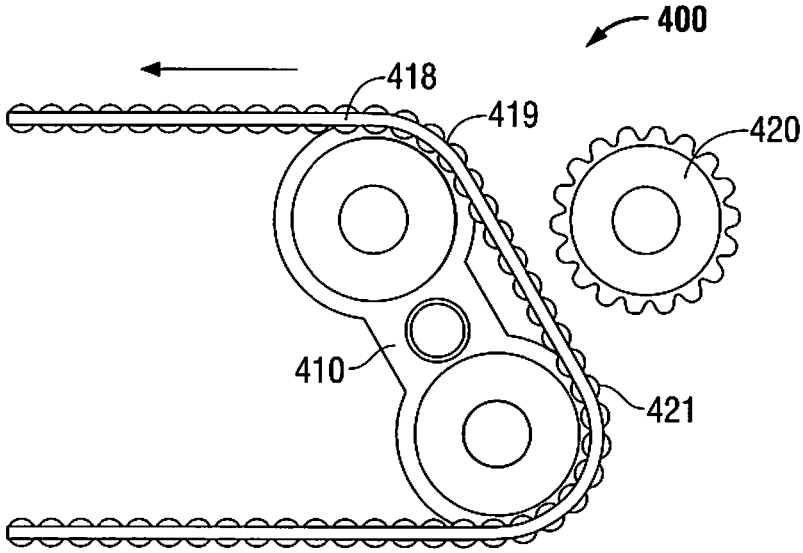
FIG. 9 is a view of still another embodiment of an asymmetrical damping mechanism in accordance with the present disclosure shown in a first, non-damped position.
Figure 10:
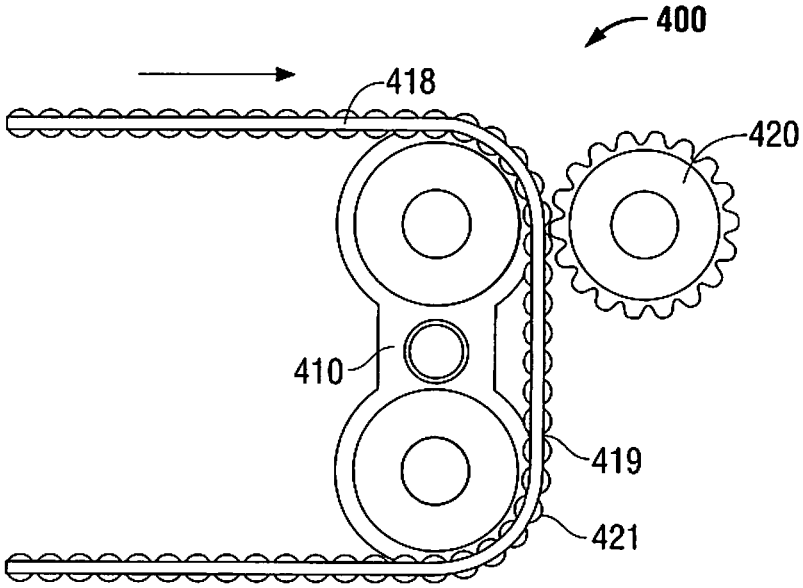
FIG. 10 is a view of the FIG. 9 embodiment of an asymmetrical damping mechanism in accordance with the present disclosure shown in a second, damped position.

Turning to FIGS. 9 and 10, still another embodiment of an asymmetrical damping mechanism 400 in accordance with the present disclosure is shown wherein a damping roller 420 is disposed outside of a perimeter defined by drive belt 418. Drive belt 418 is of a toothed type having a plurality of drive teeth 421 disposed on at least an outer surface 419 thereof. A pivoting arm assembly 410 is configured such that as the drive belt moves in a clockwise direction, e.g., a direction corresponding to the closing of a pair of media support members (not explicitly shown), the pivoting arm 410 rotates in a clockwise direction, causing the outer teeth 421 of drive belt 418 to engage damping roller 420.

Figure 11:
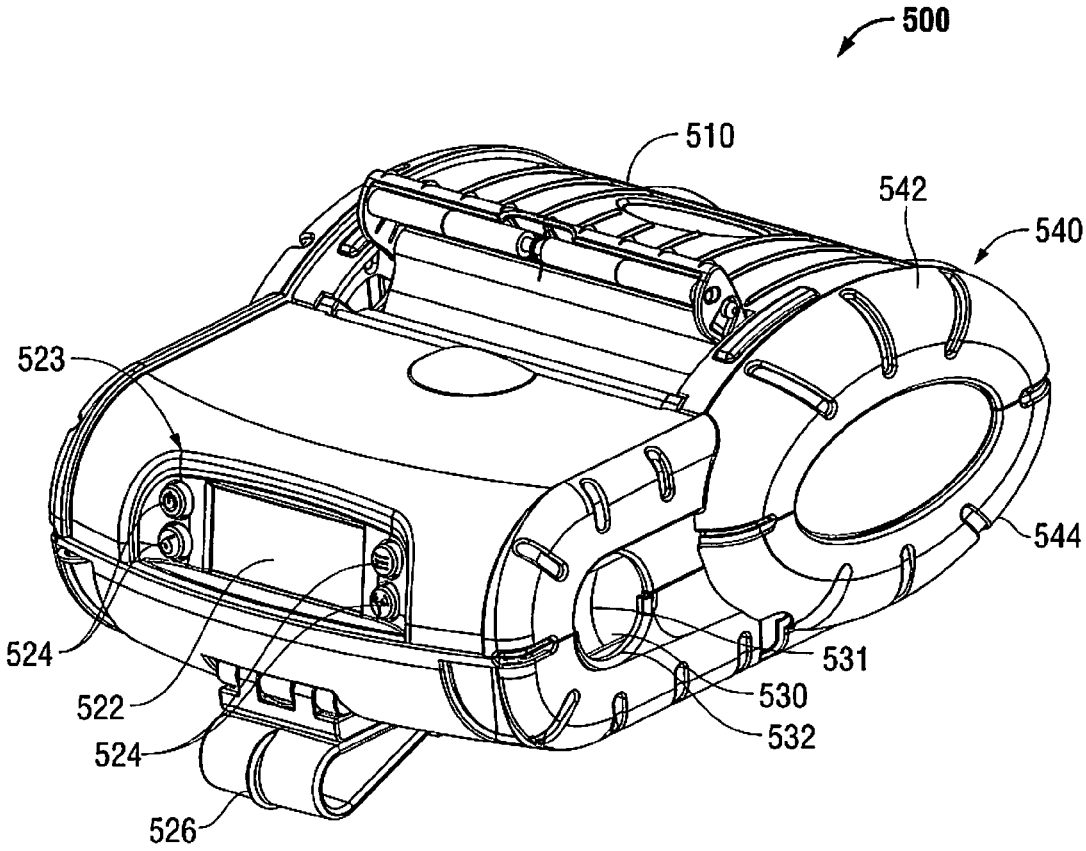
FIG. 11 is a perspective view of an embodiment of a portable printer in accordance with the present disclosure.
Figure 12:
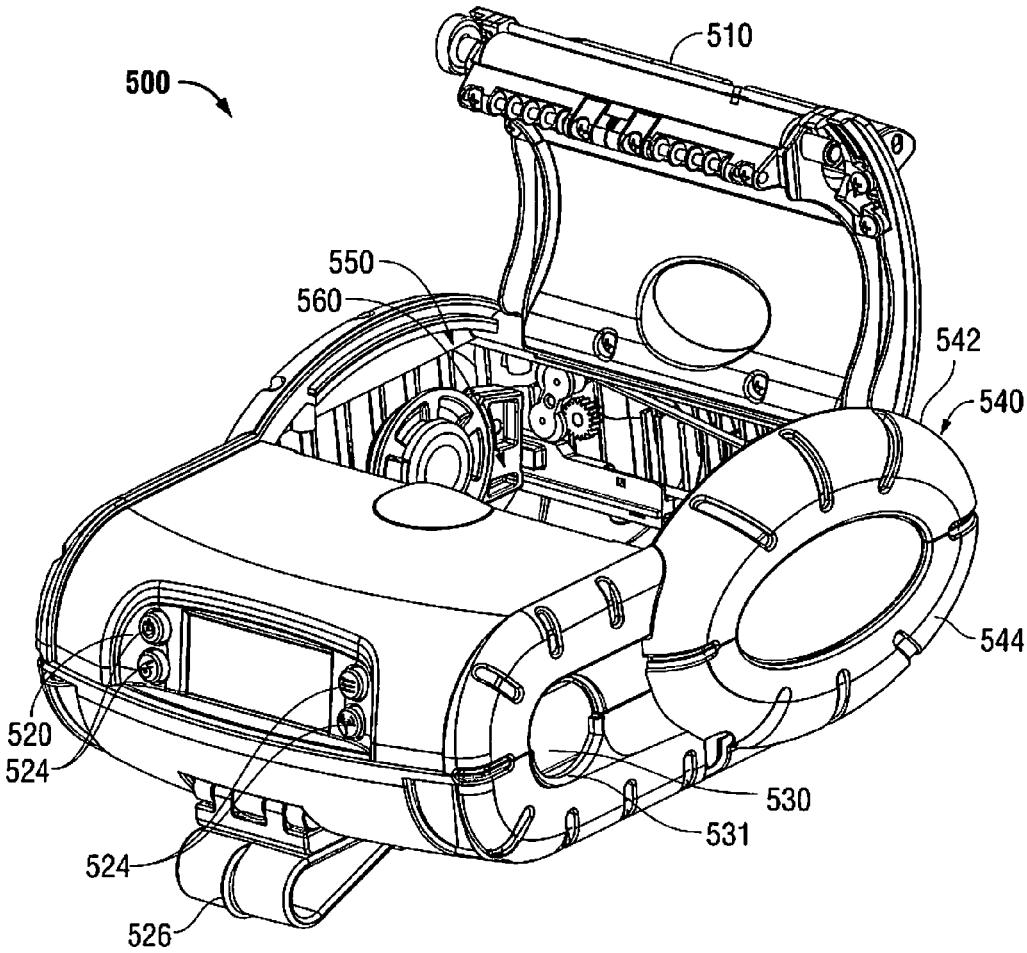
FIG. 12 is another perspective view of the FIG. 11 embodiment of a portable printer in accordance with the present disclosure.

Turning to FIGS. 11 and 12, an embodiment of a portable printer 500 in accordance with the present disclosure includes a control panel 523 having an overmolded bezel 520 associated therewith. The overmolded bezel 520 is formed from resilient material that may provide shock resistance and prevent the infiltration of contaminants into the control panel 523, printer 500, user interface element(s) 524, and components associated therewith. The control panel 523 includes a display 522 that is adapted to present operational information to a user. By way of example, and without limitation, the display 522 may present status information, diagnostic information, setup information, and the like. Display 522 may include a text display, a graphical display, a monochrome display, a color display, and may include any display means now or in the future known, including without limitation a liquid crystal display (LCD), a light emitting diode (LED) display, an organic light emitting diode (OLED) display, a vacuum fluorescent display, and the like. Control panel 523 includes one or more user interface elements 524, e.g., buttons and/or switches, adapted to accept user inputs. The overmolded bezel 520 may include the one or more user interface elements 524, such that the resilient material of the bezel 520 provides a seal associated with the one or more user interface elements 524.

Figure 13:
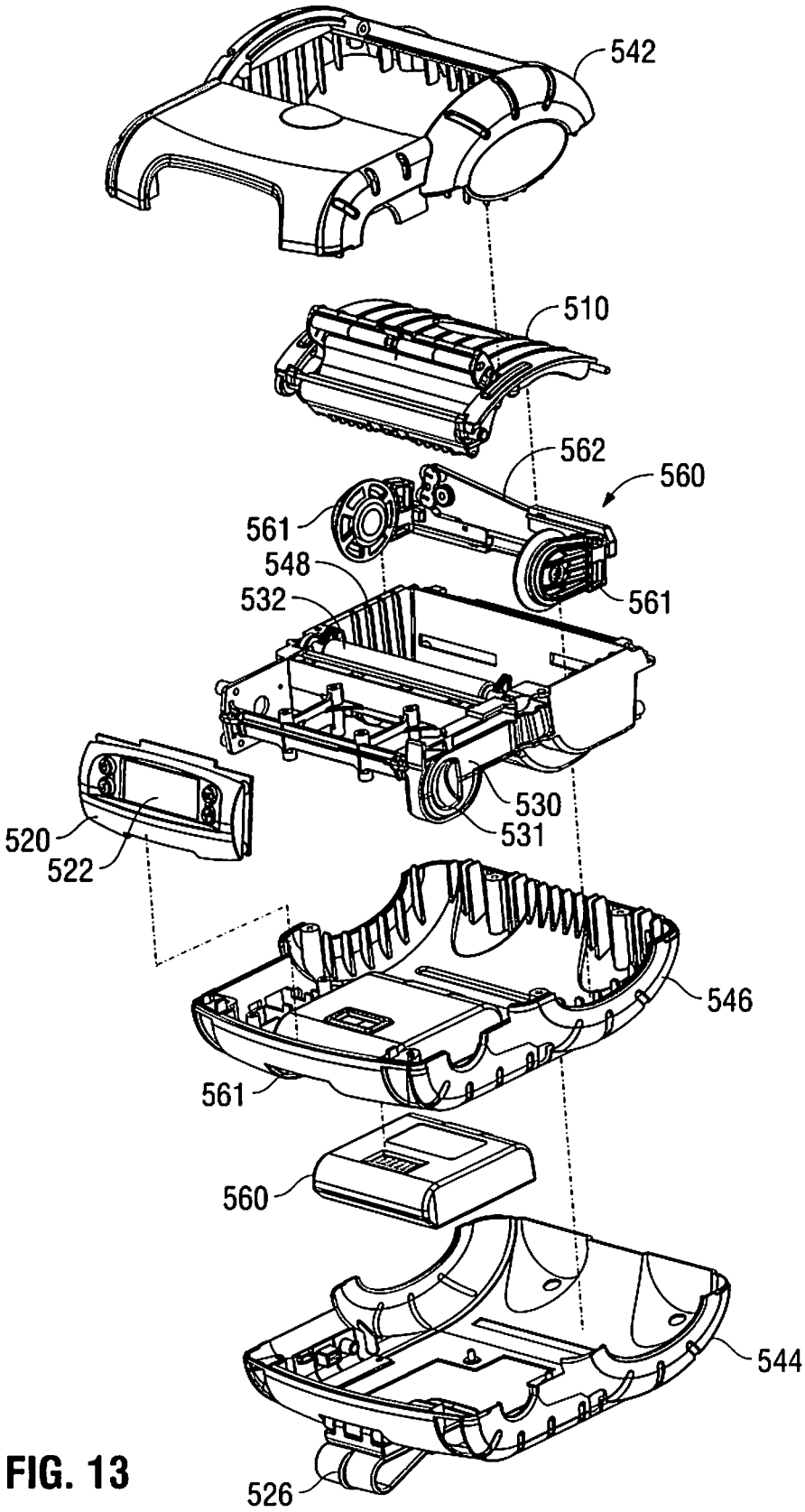
FIG. 13 is an exploded view of the FIG. 11 embodiment of a portable printer in accordance with the present disclosure.

Printer 500 includes a housing 540 having an upper housing 542 and a lower housing 544. A media access door 510 is provided to facilitate the loading and unloading of media (not explicitly shown) in a media well 550. As shown in FIG. 13, media centering assembly 560 is positioned within media well 500. Media centering assembly includes a pair of media support members 561 and an asymmetrically-damped centering mechanism 562 as described hereinabove. Printer 500 includes a belt clip 526 affixed to the lower housing 544 thereof. Belt clip 526 may be removably coupled to lower housing 544 by any suitable manner of attachment, such as without limitation threaded fasteners, one or more clips, and the like.

Figure 14:
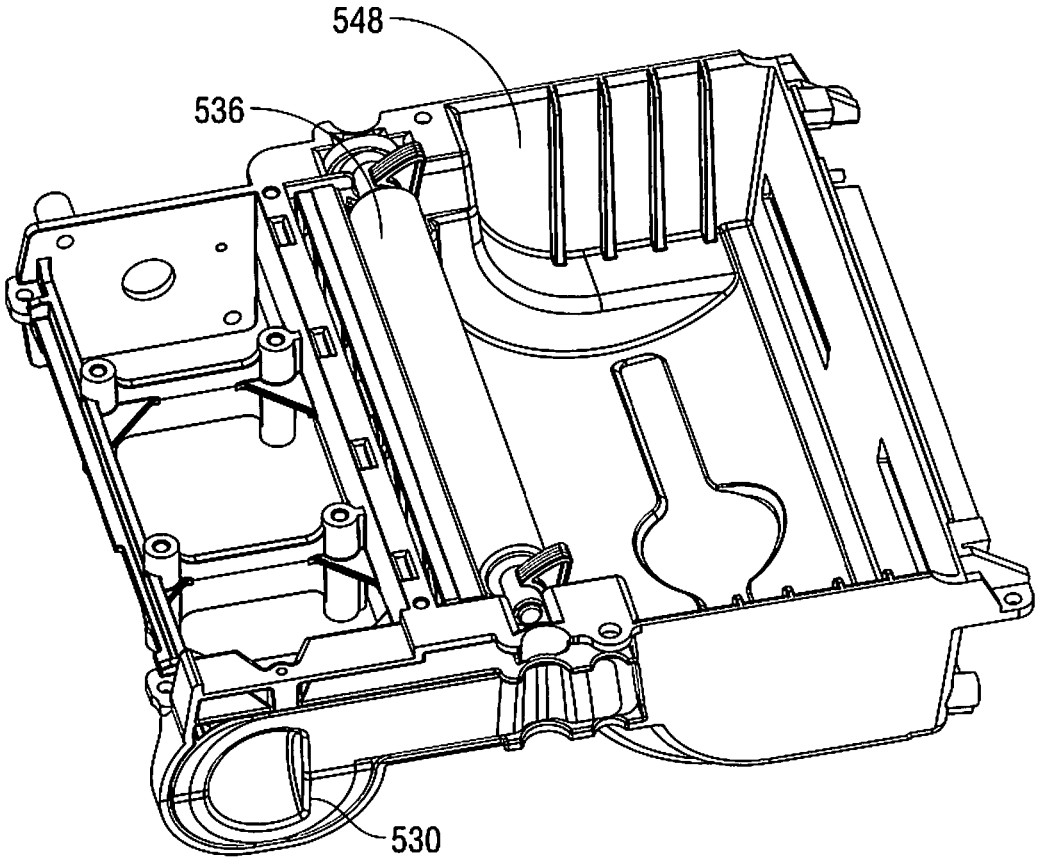
FIG. 14 illustrates an inner frame of an embodiment of a portable printer in accordance with the present disclosure.

Printer 500 includes an upper inner frame 548, as shown in FIG. 14, and a lower inner frame 546. The combination of upper inner frame 548 and lower inner frame 546 provides an inner support structure, which, in combination with upper housing 542 and lower housing 544, forms a dual-wall housing assembly that provides increased impact resistance and rigidity. Latch lever 530 is operably associated with media cover 510 such that actuation of latch lever 530 disengages one or more latches (not explicitly shown) to permit media cover 510 to open. Media cover 510 is configured to be positioned in at least a first, closed position as shown in FIG. 11 and a second, open position as shown in FIG. 12. Detents are provided in association with media cover 510 to retain media cover 510 in each of the open and closed positions. A spring (not explicitly shown) may be associated with media cover 510 and configured to bias media cover 510 toward an open position as shown in FIG. 12. Upper inner frame 548 provides support for latch lever 530. An opening 532 is defined in housing 540 to facilitate access to and actuation of latch lever 530. A fingertip recess 531 is defined in latch lever 530 to enable the convenient actuation thereof by, e.g., the fingertip of a user. In this manner, media cover 510 may be unlatched using a single-handed motion to expose media storage well 550 for loading and loading media. A media roller 536 is operably associated with upper inner frame 548 to facilitate feeding of media along a print path.

Lower inner frame 546 includes a battery well 561 that is adapted to operably receive a battery pack 560. Battery pack 560 may include one or more cells, which may be connected in series, in parallel, or in a combination of series and parallel, to provide operating power to printer 500. Battery pack 560 may include a primary battery (e.g., non-rechargeable), a secondary battery (e.g., rechargeable), and or combinations thereof. Battery pack 560 may include an identifier, e.g., a physical, an electrical, or an optical identifier, that identifies to the printer 500 one or more characteristics of the battery pack 560. Such characteristics may include, without limitation, a voltage, an amperage, an ampere-hour rating, a battery type (e.g., NiCd, NiMH, Li-ion), and a charge cycle count.

Figure 15:
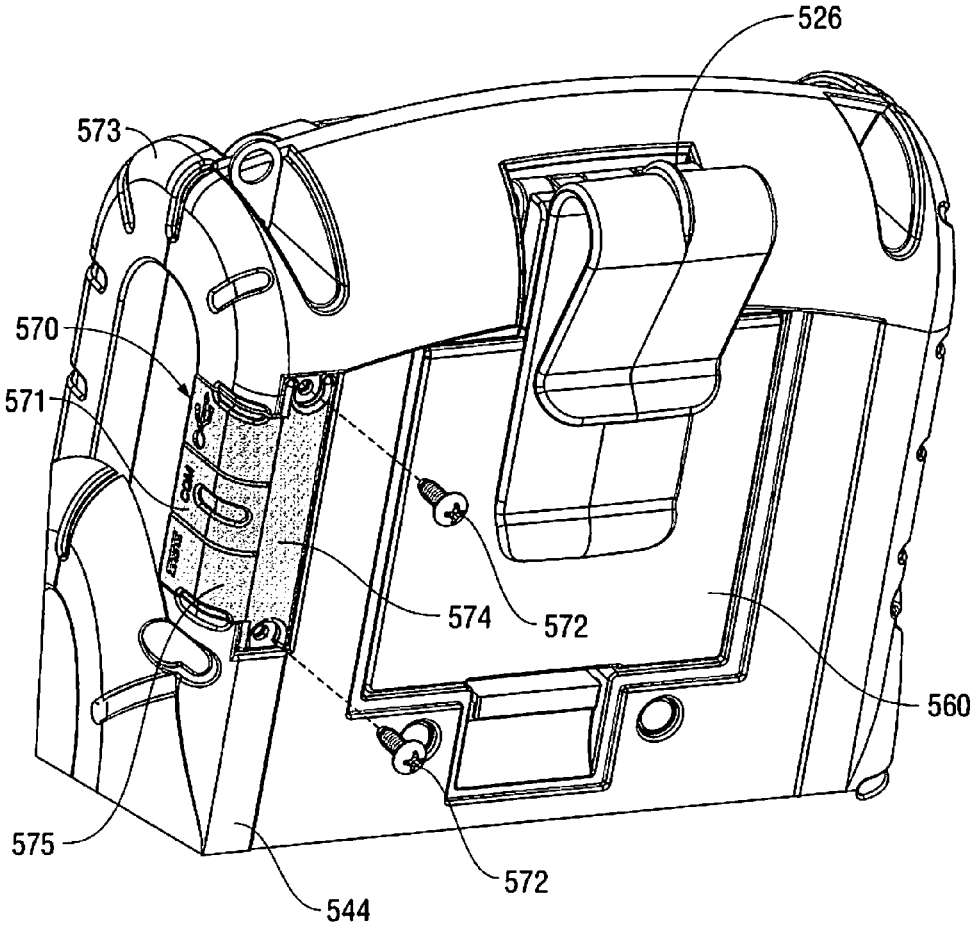
FIG. 15 illustrates an embodiment of a dust cover assembly for a portable printer in accordance with the present disclosure.

As shown in FIG. 15, printer 500 includes dust cover assembly 570 that is dimensioned to cover one or more connectors (not explicitly shown). The dust cover assembly 570 may be formed from resilient material, e.g., silicone, neoprene, or other elastomeric material. The dust cover assembly includes a cap 571 that is joined to a base 574 by a resilient hinge or tethering member 575 that retains the cap 571 to the base 574. The cap 571, hinge member 575, and base 574 may be integrally formed. Hinge member 575 may be a living hinge. The base 575 is retained to lower housing 544 by any suitable manner of fastening, including without limitation, threaded fasteners 572, clips, tabs, and the like. Advantageously, the dust cover assembly may be user-replaceable, so that a worn or broken dust cover assembly 570 may be readily replaced with a new dust cover assembly 570. In embodiments, a spare dust cover assembly 570 may be stored within a recess provided by the printer housing (not explicitly shown.)

The described embodiments of the present disclosure are intended to be illustrative rather than restrictive, and are not intended to represent every embodiment of the present disclosure. Further variations of the above-disclosed embodiments and other features and functions, or alternatives thereof, may be made or desirably combined into many other different systems or applications without departing from the spirit or scope of the disclosure as set forth in the following claims both literally and in equivalents recognized in law.

What is claimed is:

1. An asymmetrically-damped media centering mechanism, comprising a first media support member moveable along a longitudinal axis thereof;

a second media support member moveable along a longitudinal axis thereof;

a reciprocal movement mechanism operably coupled to the first and second media support members, the reciprocal movement mechanism configured to translate a longitudinal movement of the first media support member into a corresponding opposite longitudinal movement of the second media support member;

a pivoting arm coupled to the reciprocal movement mechanism and pivotable between at least a first and a second position, wherein the pivoting arm pivots to the first position when the first and second media support members are moved closer to each other, and the pivoting arm pivots to the second position when the first and second media support members are moved further apart from each other; and a damping gear configured to operably engage the reciprocal movement mechanism when the pivoting arm mechanism is in the first position and to disengage the reciprocal movement mechanism when the pivoting arm mechanism is in the second position.

2. An asymmetrically-damped media centering mechanism in accordance with claim 1, wherein the pivoting arm includes a driven gear operatively coupled to the reciprocal movement mechanism.

3. An asymmetrically-damped media centering mechanism in accordance with claim 2, wherein the driven gear engages the damping gear when the pivoting arm is in the first position.

4. An asymmetrically-damped media centering mechanism in accordance with claim 1, wherein the damping gear includes damping grease.

5. An asymmetrically-damped media centering mechanism in accordance with claim 1, further comprising a biasing member configured to bias the first and second media support members toward each other.

6. An asymmetrically-damped media centering mechanism in accordance with claim 5, wherein the biasing member includes an extension spring.

7. An asymmetrically-damped media centering mechanism in accordance with claim 1, wherein the reciprocal movement mechanism further comprises:

a first drive member operably coupled to the first media support member; and a second drive member operably coupled to the second media support member.

8. An asymmetrically-damped media centering mechanism in accordance with claim 7, further comprising a drive belt operably coupled to the first and second drive members and at least partially disposed around the driven gear.

9. An asymmetrically-damped media centering mechanism in accordance with claim 7, wherein the first and second drive members include a notched region dimensioned to receive a drive belt.

10. An asymmetrically-damped media centering mechanism in accordance with claim 1, wherein the reciprocal movement mechanism further comprises:

a first rack member operably coupled to the first media support member;

a second rack member operably coupled to the second media support member; and a pinion gear operably engageable with the first and second rack members and configured to translate movement of the first rack member into a corresponding opposite movement of the second rack member.

11. An asymmetrically-damped media centering mechanism in accordance with claim 10, wherein the pinion gear is axially coupled to the driven gear.

12. In a portable printer, a method of centering a media roll, comprising:

providing a first and a second media support member movable along a longitudinal axis and dimensioned to axially engage a media roll;

providing a reciprocal movement mechanism operably coupled to the first and second media support members wherein a longitudinal movement of one media support member causes a corresponding opposite longitudinal movement of the other media support member;

providing a pivoting arm operably coupled to the reciprocal movement mechanism, wherein the pivoting arm pivots to the first position when the media support members are moved closer to each other, and the pivoting arm pivots to the second position when the media support members are moved further apart from each other; and providing a damping gear configured to engage the reciprocal movement mechanism when the pivoting arm is in the first position and to disengage the reciprocal movement mechanism when the pivoting arm is in the second position.

13. A method of centering a media roll in accordance with claim 12, further comprising biasing the media support members toward each other.

14. A method of centering a media roll in accordance with claim 12, wherein rotation of the damping gear is impeded by damping grease.

* * * * *